US006354904B1

(12) United States Patent
Grey et al.

(10) Patent No.: US 6,354,904 B1
(45) Date of Patent: Mar. 12, 2002

(54) COLLAPSIBLE REUSABLE PIÑATA

(76) Inventors: Ronald Brian Grey, 1040 Sand Bar Cir., Carmichael, CA (US) 95608; David Alva, 5027 Blanchard Ct., Fair Oaks, CA (US) 95628

( * ) Notice: Subject to any disclaimer, the term of this patent is extended or adjusted under 35 U.S.C. 154(b) by 0 days.

(21) Appl. No.: 09/759,058

(22) Filed: Jan. 11, 2001

(51) Int. Cl.[7] ..... A63H 33/00
(52) U.S. Cl. ..... 446/5; 446/487
(58) Field of Search ..... 446/4, 5, 69, 71, 446/77, 79, 487, 488, 489; 229/108.1

(56) References Cited

U.S. PATENT DOCUMENTS 4,167,078 A * 9/1979 Oquita ..... 446/5
4,186,514 A * 2/1980 Oquita ..... 446/5
5,242,308 A * 9/1993 Estrata ..... 446/5
5,536,194 A * 7/1996 Larsen et al. ..... 446/5
5,562,518 A * 10/1996 Estrada ..... 446/5
6,171,166 B1 * 1/2001 Oquita ..... 446/5

* cited by examiner

*Primary Examiner*—Kien T. Nguyen
(74) *Attorney, Agent, or Firm*—Risto A. Rinne, Jr.

(57) ABSTRACT

An apparatus for use at parties resembles a cardboard box that is open at the top and is supported in mid air. The box stores candy or toys therein and includes a latch that is released subsequent to pulling on a trigger cord. The latch includes a pin in a side member that engages a hole attached to a flap of a bottom member. The trigger cord pulls the flap away from the pin which then releases the bottom member which is able to pivot and release the candy or toys which then fall to the ground. VELCRO is used to ensure that the flap is maintained in a closed position until the trigger cord is pulled. A plurality of false cords resemble the trigger cord and they all dangle through openings that are provided in the bottom member.

9 Claims, 2 Drawing Sheets

COLLAPSIBLE REUSABLE PIÑATA

BACKGROUND OF THE INVENTION

1. Field of the Invention

The present invention, in general relates to piñatas and, more particularly, to piñatas that are reusable and which collapse for storage or sale.

Piñatas are well known party favors. They are used at birthdays and for other types of celebrations. Typically, a piñata is filled with candy or other desirable articles, such as toys, and is struck with an object (i.e., a stick) by each member of the group in turn until it is destroyed and the contents are released.

The problem is that only one member of the group actually causes the contents to be released. The remaining members are left feeling discouraged.

Also, little children typically are unable to wield a stick with sufficient force to actually break open a typical piñata and, as such, are doomed to failure.

Furthermore, a reusable piñata must fold compactly for storage, otherwise a large and cumbersome type of a piñata would have to be transported and stored, which would discourage sales and use. Shopkeepers would not mind displaying one opened piñata but they would not want to fill up their stores with large bulky devices. Also, additional shipping charges for oversize articles would make transport of a non-collapsing piñata prohibitive.

The ideal piñata would also be inexpensive to manufacture and therefore, also to sell.

Finally, a reusable piñata must secure in a closed position effectively. It must resist opening by normal jiggling and shaking, that normally occurs during use so that only the proper action (not shaking of the piñata) actually releases the contents.

Accordingly, a secure piñata latch mechanism is desired. Furthermore, use of the piñata latch mechanism must not, in any way, provide any suggestion that favors or reveals how to release the latch mechanism.

Ideally, a piñata that is reusable would allow repeated attempts to access the contents. This would also save the cost of having to purchase new piñatas each time one was desired.

It is also desirable to provide all members of the group with an equal chance of opening the piñata.

It would be desirable if the contents could be refilled for each subsequent use with candy or toys, as desired, to best suit the needs of all group members.

An ideal piñata would also fold (i.e., collapsible) for storage and ease in transportation.

Accordingly, there exists today a need for a collapsible, reusable piñata that provides an equal chance for all members to open, is reusable, folds compactly when not in use, and has a secure latch mechanism that does not open when it is not intended to open yet freely opens when it is desired to open and is inexpensive to manufacture and ship.

Clearly, such an apparatus would be a useful and desirable device.

2. Description of Prior Art

Piñatas are, in general, known. For example, the following patents describe various types of these devices:

U.S. Pat. No. 4,167,078 to Oquita, Sep. 11, 1979;

U.S. Pat. No. 4,186,514 to Oquita, Feb. 5, 1980;

U.S. Pat. No. 5,242,308 to Estrada, Sep. 7, 1993; and

U.S. Pat. No. 5,536,194 to Lasen, et al., Jul. 16, 1996.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a collapsible, reusable piñata that is inexpensive to manufacture.

It is also an important object of the invention to provide a collapsible, reusable piñata that can be collapsed when not in use.

Another object of the invention is to provide a collapsible, reusable piñata that is reusable.

Still another object of the invention is to provide a collapsible, reusable piñata that can be hung (i.e., suspended).

Still yet another object of the invention is to provide a collapsible, reusable piñata that is released by pulling a trigger ribbon disposed among a plurality of look-alike false trigger ribbons.

Yet another important object of the invention is to provide a collapsible, reusable piñata that includes a secure latching mechanism.

Still yet another important object of the invention is to provide a collapsible, reusable piñata that can be quickly and easily refilled.

Briefly, a collapsible, reusable piñata that is constructed in accordance with the principles of the present invention is preferably formed of corrugated material (i.e., cardboard) and includes a collapsible enclosure that has a planar bottom member and four planar side members, each of the side members being attached at a ninety degree angle with respect to two of the remaining side members and also being disposed at a ninety degree angle with respect to the bottom member when the piñata is assembled, ready for use. The bottom member is hingedly attached on one side to one of the four side members and it includes a flap that is hingedly attached to a distal end of the bottom member with respect to where the bottom member is attached to the side member. The four side members are hingedly attached to each side member which they abut. When assembled, the piñata forms a rectangular structure with an open top. Support cords attach to the tops of each of the side members to support the piñata above the ground. A releasable latch mechanism includes a first half that is attached to one of the side members and a second half that is attached to the flap and which cooperate to secure the bottom member in perpendicular alignment with respect to the side members until a trigger ribbon (i.e., cord) is pulled. The trigger ribbon is disposed among a plurality of false ribbons, each of which resembles the other in appearance.

DETAILED DESCRIPTION OF THE INVENTION

Figure 1:
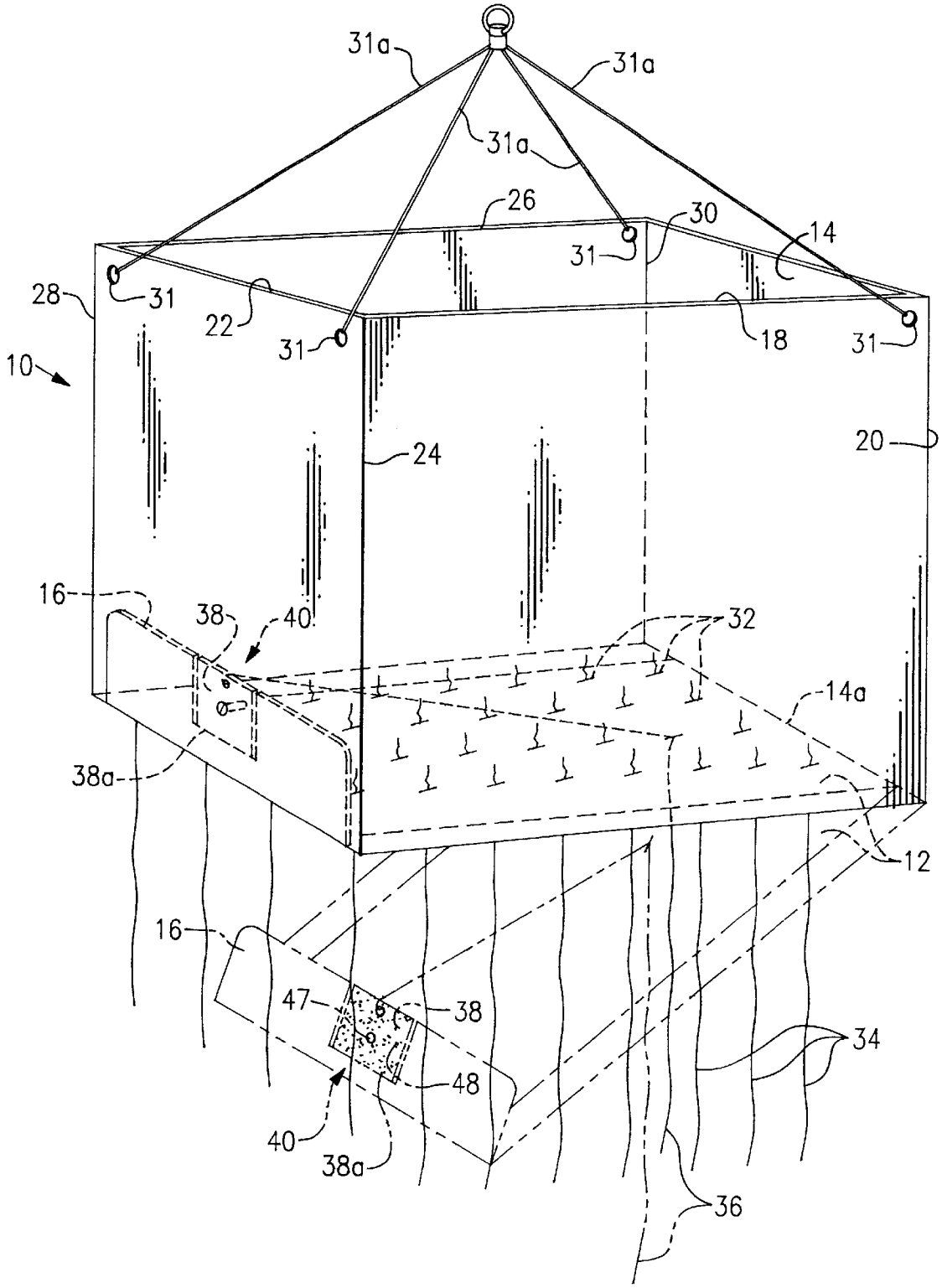
FIG. 1 is a view in perspective of a collapsible, reusable piñata in an assembled position and showing a bottom member also in an opened position in dashed lines.

Referring to all of the FIGURE drawings and in particular to FIG. 1 is shown, a collapsible, reusable piñata, identified in general by the reference numeral 10.

The piñata 10 includes a planar bottom member 12 that is pivotally attached to a first side member 14 along an axis created by a seam 14*a* that is intermediate the bottom member 12 and the first side member 14.

The bottom member 12 includes a flap 16 that is disposed opposite the seam 14*a*. The flap 16 is similarly pivotally (i.e., hingedly) attached to the bottom member 12.

The preferred material to form the enclosure portion of the piñata 10 is corrugated fiber, commonly referred to as cardboard. The enclosure, once assembled, resembles a cardboard box (without a top) in appearance.

A second side member 18 is pivotally attached to the first side member 14 along a second seam 20. A third side member 22 is pivotally attached to the second side member 18 along a third seam 24. A fourth side member 26 is pivotally attached to the third side member 22 along a fourth seam 28 and is pivotally attached to the first side member 14 along a fifth seam 30.

The first, second, third, and fourth side members 14, 18, 22, 26 are normal (i.e., perpendicular) with respect to each other when the piñata 10 is assembled ready for use.

The second, third, fourth, and fifth seams 20, 24, 28, 30 allow the first, second, third, and fourth side members 14, 18, 22, 26 to pivot and collapse into a flat position with the second side member 18 disposed substantially against the first side member 14 and third side member 22 disposed substantially against the fourth side member 26.

When the piñata 10 is collapsed for storage, the bottom member 12 is adapted to pivot back around the seam 14*a* so that it too is disposed substantially against the first side member 14 but on the opposite side thereof as is the second side member 18 disposed.

While a cube shape is preferred, the overall shape of the piñata 10, when assembled and ready for use may be that of any rectangular box.

During use, each of the side members 14, 18, 22, 26 is disposed in perpendicular planar alignment with respect to each adjoining side member (i.e., the first side member 14 is perpendicular with respect to the second and fourth side members 18, 26, etc.) and in parallel planar alignment with respect to an opposite planar side member (i.e., the first side member 14 is disposed in parallel planar alignment with respect to the third side member 22, etc.).

Each of the side members 14, 18, 22, 26 is disposed in perpendicular planar alignment with respect to the bottom member 12 during use and prior to the release of the contents in the piñata 10, as is described in greater detail hereinafter.

Each of the side members 14, 18, 22, 26 includes a support hole 31 through which one of four support cords 31*a* are attached. The support cords 31*a* are preferably tied together and to an object (not shown) that is overhead and able to support the weight of the piñata 10 and any forces that are applied to the piñata 10 during its use.

The bottom member 12 includes a plurality of identical openings 32. The openings 32 are scattered either in a pattern or randomly about the bottom member. A preferred type of an opening includes a cut or a "slit" that is formed through the bottom member 12.

A plurality of false cords 34 are each threaded through one of the openings 32 and allowed to hang under the piñata 10. A small segment of each of the false cords 34 extends into the interior of the piñata 10.

The false cords 34 are preferably made of attractive colored ribbon segments.

When any of the false cords 34 are pulled from under the piñata 10 by a child hoping to open the piñata 10, its small segment is readily pulled through the opening 32 without effect.

Disposed though any one of the openings 32 a trigger cord 36 is allowed to pass and to hang under the piñata 10 in a manner similar to that of the false cords 34. The trigger cord 36 is allowed to hang the same length below the piñata 10 as the false cords 34 and is similarly colored so as to not provide any visual cue to suggest that it might in any way be different than any of the false cords 34.

An opposite end of the trigger cord 36 extends inside of the assembled piñata 10 and connects with a central flap 38.

The central flap 38 is pivotally attached to the flap 16 along a flap seam 38*a* and is preferably disposed near its center. The central flap 38 includes a pair of cuts 38*b* that are disposed on opposite sides thereof and which extend into the flap 16 an amount that is equal to the depth of the central flap 38 and less than that of the flap 16 itself.

The central flap 38 includes a first half of a latch assembly identified in general by the reference numeral 40 that is used to retain the bottom member 12 in perpendicular alignment with respect to the side members 14, 18, 22, 26.

Figure 2:
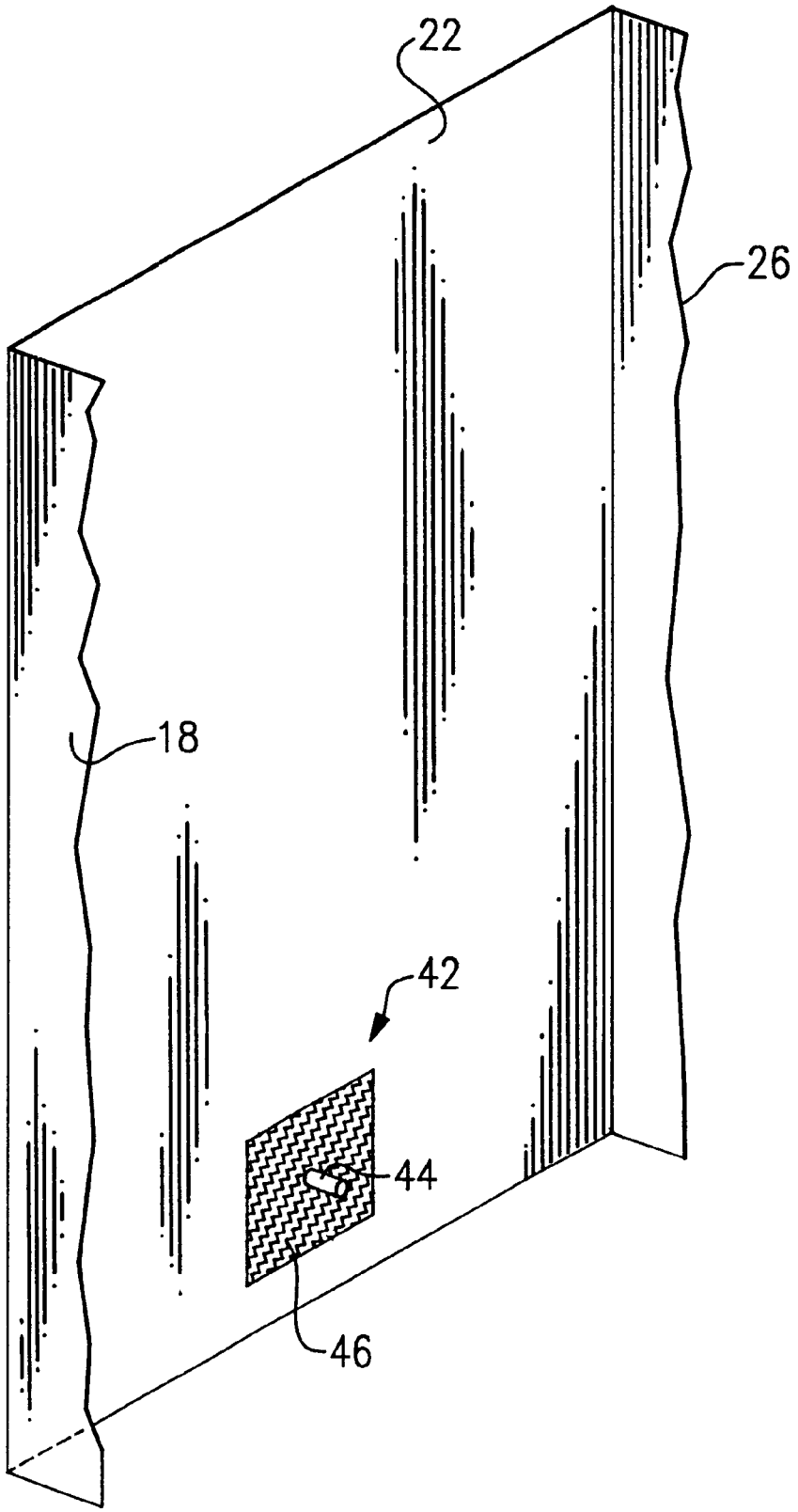
FIG. 2 is a detailed view in perspective of a portion of the latch mechanism of the collapsible, reusable piñata.

A second half of a latch assembly is attached to the third side member 22 near the bottom and is identified in general by the reference numeral 42. (See FIG. 2)

The second half 42 includes a pin 44 that passes through the third side member 22 and extends into the interior of the piñata 10.

A section of a first half of a hook and loop fastener 46, such as is commonly sold under the tradename VELCRO surrounds the pin 44.

The pin 44 may be formed from a small bolt and nut or any plastic or metallic substance that is sufficiently strong enough to bear the weight of any items placed in the piñata 10.

The first half of a latch assembly 40 that is attached to the central flap 38 includes a reinforced hole 47 that is adapted to receive the pin 44 therein.

The reinforced hole 47 passes through the central flap 38 and it includes a grommet or a reinforcing ring that resists wear or damage that would otherwise be caused by the force of the contents (not shown) applying force to the bottom member 12 which in turn is held in a closed position by the pin 44.

The trigger cord 36 is preferably attached near the top of the central flap 38 and the reinforced hole 47 is nearer to the center thereof.

Around the reinforced hole 47 is disposed a quantity of a section of a second half of a hook and loop fastener 48.

To use the piñata 10, the bottom member 12 is pivoted until it aligns with the bottom edges of each of the four side members 14, 18, 22, 26. A pair of side flaps 50 that are attached to the bottom member 12 are inserted inside the pi ñata 10.

The flap 16 is brought up against the inside of the third side member 22. The central flap 38 is pivoted away from the third side member 22 so that the reinforced hole 47 (in the central flap 38) can clear the pin 44.

Once the reinforced hole 47 is disposed proximate the pin 44, a person (not shown) urges the central flap 38 to pivot closer toward the third side member 22. The reinforced hole 47 passes over the pin 44 and the central flap 38 is urged even further toward the third side member 22 until the second half of a hook and loop fastener 48 makes contact with the first half of a hook and loop fastener 46 and secures the central flap 38 to the third side member 22.

When the trigger cord 36 alone is pulled, the central flap 38 is accordingly urged away from the third side member 22. First, the second half of a hook and loop fastener 48 is separated apart from the first half of a hook and loop fastener 46.

As the trigger cord 36 is pulled some more, the central flap 38 continues to pivot around the flap seam 38*a* toward the interior of the piñata 10 until the reinforced hole 47 is pulled beyond the pin 44. At that point, the bottom member 12 is no longer held in position and the weight of the contents therein plus the force applied to the trigger cord 36 urge the bottom member 12 to pivot about the seam 14*a* until the contents are released and spill out from the bottom of the pi ñata 10.

To reuse the piñata 10, the bottom member 12 is once again closed and the above described procedure for securing the bottom member 12 is repeated, as desired.

To store the piñata 10 the trigger cord 36 is pulled to release the bottom member 12 which is pivoted fully around the first side member 14 until it contacts it. The four side members 14, 18, 22, 26 fold together flat, as was discussed hereinabove.

The first half of a latch assembly 40 and the second half of a latch assembly 42 cooperate to provide a fast, inexpensive latching mechanism that holds the bottom member 12 securely in place until the trigger cord 36 is pulled, at which time an easy and positive release of the latching mechanism is accomplished.

It is noted that it is easier to pivot the central flap 38 than the entire flap 16 and it is therefore easier to pull the central flap 38 away from the pin 44 than it would be to pull the entire flap 16 away from the pin. Accordingly, the latching mechanism is very easy to release.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A collapsible, reusable piñata, comprising:

(a) four upstanding walls, each of said four walls being pivotally attached to two adjacent of said four upstanding walls, said walls being normally disposed at right angles with respect to each other so as to form a box with an open top when said piñata is adapted for use;

(b) a bottom planar member, being pivotally attached at one end thereof to a bottom of one of said four upstanding walls and including a plurality of openings therethrough; and (c) a latch for detachably-attaching said bottom member to one of said four upstanding walls when said piñata is adapted for use, said bottom member being disposed in a perpendicular planar orientation with respect to said four upstanding walls and said piñata being adapted to receive and retain items therein when said bottom member is secured by said latch to said one of said four upstanding walls and wherein said pinata is adapted to dispense said items when said latch is released and wherein said latch includes a first portion thereof that is attached to said one of said four upstanding walls, said first portion including a pin that extends into an interior of said piñata and a first half of a hook and loop fastener disposed proximate said pin, and wherein said latch includes a second portion thereof, said second portion including a flap attached to said bottom member, said flap including a hole therein said hole adapted to receive said pin therein and said flap including a second half of a hook and loop fastener disposed proximate said hole, said second half of a hook and loop fastener adapted to cooperate with said first half of a hook and loop fastener when said pin is disposed in said hole sufficient to retain said latch in a closed position, and including a trigger cord attached at one end thereof to said flap and extending through one of said openings; and (d) means for suspending said piñata;

whereby said latch is adapted to be released when said trigger cord is pulled.

2. The piñata of claim 1 wherein said hole is reinforced.

3. The piñata of claim 1 including a plurality of false cords disposed in certain of said openings.

4. The piñata of claim 3 wherein at least one of said false cords includes a ribbon.

5. The piñata of claim 4 wherein said ribbon is colored.

6. The piñata of claim 1 wherein said trigger cord includes a ribbon.

7. The piñata of claim 6 wherein said ribbon is colored.

8. The piñata of claim 1 wherein each of said four upstanding walls and said bottom member are formed of cardboard.

9. The piñata of claim 1 wherein said flap includes a center flap, said center flap being disposed in said flap and adapted to pivot about an axis with respect thereto, said center flap including said first portion of said latch attached thereto.

* * * * *